US009546408B2

(12) United States Patent
Sakamoto et al.

(10) Patent No.: US 9,546,408 B2
(45) Date of Patent: Jan. 17, 2017

(54) QUENCHING METHOD FOR STEEL PIPE

(75) Inventors: Akihiro Sakamoto, Tokyo (JP); Kazuo Okamura, Tokyo (JP); Kenji Yamamoto, Tokyo (JP); Tomohiko Omura, Tokyo (JP); Yuji Arai, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 264 days.

(21) Appl. No.: 14/005,853

(22) PCT Filed: Mar. 13, 2012

(86) PCT No.: PCT/JP2012/001708

§ 371 (c)(1),
(2), (4) Date: Sep. 18, 2013

(87) PCT Pub. No.: WO2012/127811

PCT Pub. Date: Sep. 27, 2012

(65) Prior Publication Data

US 2014/0007994 A1 Jan. 9, 2014

(30) Foreign Application Priority Data

Mar. 18, 2011 (JP) ..... 2011-060726

(51) Int. Cl.
*C21D 1/18* (2006.01)
*C21D 1/19* (2006.01)
(Continued)

(52) U.S. Cl.
CPC ..... *C21D 1/18* (2013.01); *C21D 6/002* (2013.01); *C21D 9/08* (2013.01); *C22C 1/02* (2013.01);
(Continued)

(58) Field of Classification Search
None
See application file for complete search history.

(56) References Cited

U.S. PATENT DOCUMENTS 2,879,192 A * 3/1959 Gogan ..... 148/644
3,189,490 A * 6/1965 Scott ..... 148/590
(Continued)

FOREIGN PATENT DOCUMENTS

CN 101962707 2/2011
JP 62-63618 3/1987
(Continued)

OTHER PUBLICATIONS

Partial Translation of JP S62-63618 A, Ishimoto et al. (Mar. 1987).*
(Continued)

*Primary Examiner* — David Sample
(74) *Attorney, Agent, or Firm* — Clark & Brody

(57) ABSTRACT

A method for quenching a steel pipe by water cooling from an outer surface thereof, where pipe end portions are not subjected to water cooling, and at least part of a main body other than the pipe end portions is subjected to water cooling. A region(s) that is not subjected to direct water cooling over an entire circumference thereof can be along an axial direction at least in part of the main body other than the pipe end portions. The start and stop of water cooling can be intermittent at least in part of the quenching. During the water cooling of the pipe outer surface, an intensified water cooling can be performed in a temperature range in which the pipe outer surface temperature is higher than Ms point. Thereafter, the cooling can be switched to moderate cooling so that the outer surface is cooled down to Ms point or lower.

18 Claims, 6 Drawing Sheets

(51) Int. Cl.

| | |
|---|---|
| ***C21D 6/00*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/18*** | (2006.01) |
| ***C22C 38/40*** | (2006.01) |
| ***C22C 1/02*** | (2006.01) |

(52) U.S. Cl.

CPC ..... *C22C 38/001* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/40* (2013.01); *C22C 38/42* (2013.01); *C22C 38/44* (2013.01); *C22C 38/46* (2013.01); *C22C 38/48* (2013.01); *C21D 1/19* (2013.01); *C21D 2221/00* (2013.01)

(56) References Cited

U.S. PATENT DOCUMENTS

| | | | | |
|---|---|---|---|---|
| 3,407,099 | A * | 10/1968 | Schell | 148/590 |
| 3,671,028 | A * | 6/1972 | Hemsath | 266/134 |
| 4,589,934 | A * | 5/1986 | Glodowski et al. | 148/508 |
| 2010/0122753 | A1 | 5/2010 | Jeong | |

FOREIGN PATENT DOCUMENTS

| | | |
|---|---|---|
| JP | 8-188827 | 7/1996 |
| JP | 9-104925 | 4/1997 |
| JP | 10-17934 | 1/1998 |
| JP | 11-080833 | 3/1999 |
| JP | 11-229037 | 8/1999 |
| JP | 2005-036308 | 2/2005 |
| JP | 2006-213933 | 8/2006 |
| JP | 2006-265657 | 10/2006 |
| KR | 100930733 | 12/2009 |
| SU | 1754791 | 8/1992 |

OTHER PUBLICATIONS

Classification and Designation of Carbon and Low-Alloy Steels, Properties and Selection: Irons, Steels, and High-Performance Alloys, vol. 1, ASM Handbook, ASM International, 1990, p , no author 140-194.*

Full English Translation of JP S62-63618 A, Ishimito et al. (Mar. 1987).*

* cited by examiner

QUENCHING METHOD FOR STEEL PIPE

TECHNICAL FIELD

The present invention relates to a method for quenching a steel tube or pipe (hereinafter, collectively referred to as "steel pipe") made of medium or high carbon type of steel, etc., and more particularly to a method for quenching a steel pipe which can effectively prevent quench cracking of a steel pipe of low or medium alloy steel containing a medium or high level of carbon, or martensitic stainless steel pipe, which may generally be prone to quench cracking when quenched by rapid cooling means such as water quenching.

Unless otherwise stated, the definitions of terms herein are as follows.

The symbol "%" represents mass percentage of each component contained in an object such as medium or high carbon type of steel and martensitic stainless steel.

The term "low alloy steel" refers herein to steel in which amounts of alloy elements are not more than 5%.

The term "medium alloy steel" refers herein to steel in which amounts of alloy elements are in the range of 5% or more to 10% or less.

BACKGROUND ART

As one fundamental method to strengthen steel materials, methods of utilizing phase transformation by heat treatment, particularly martensitic transformation, have widely been practiced. Since a steel pipe made of medium carbon steel or high carbon steel (typically, a steel pipe of low alloy steel or medium alloy steel) exhibits excellent strength and toughness after being quenched and tempered, methods for strengthening steel materials by quenching and tempering have been used in many applications including machine structural members, and steel products for oil well use. The strength of steel can be remarkably increased by quenching, and this strengthening effect depends on C content in the steel. However, since martensite structure as quenched is generally brittle, it is subjected to tempering at a temperature not more than $A_{c1}$ transformation point after quenching, thereby improving its toughness.

To obtain a martensite structure by quenching low alloy steel or medium alloy steel, rapid cooling such as water quenching is necessary. If cooling rate is insufficient, a structure softer than martensite, such as bainite, would be mixed with martensite so that sufficient quenching effect cannot be achieved.

In quenching treatment of steel materials, quench cracking may become an issue. As described above, when a steel product is rapidly cooled, it is inevitably impossible to uniformly cool the entire steel product, and then thermal stress is generated in the steel product, attributable to the difference in the contraction rate between an early cooled portion and a late cooled portion. Further, when a quenching treatment causes martensitic transformation, transformation stress is generated as a result of occurrence of volume expansion due to transformation from austenite to martensite. The volume expansion depends on a C content in steel, and the more the C content is, the larger the volume expansion becomes. Therefore, the steel having a high C content is prone to have large transformation stress in a quenching stage, and is highly likely to cause quench cracking.

In particular, when the steel product to be quenched has a tubular shape, it exhibits a very complex stress state, compared to other shapes such as flat plate shape, or a bar/wire shape. For this reason, if a tubular steel product having a high C content is subjected to rapid cooling, such as water quenching, crack susceptibility remarkably increases and quench cracking frequently occurs, resulting in a very poor yield of the product.

Therefore, when a steel pipe containing a high carbon among low alloy steels and medium alloy steels is quenched, the cooling rate during the quenching treatment is controlled by performing oil quenching which has a lower cooling capacity compared to water quenching, or performing relatively slow cooling by mist cooling, in order to prevent quench cracking and increase the yield of product.

However, when such quenching means is adopted, a sufficient amount of martensite structure cannot be obtained, resulting in a mixed microstructure including a considerable amount of bainite which occurs at a comparatively elevated temperature. For that reason, there arises a problem that even if quenching and tempering is applied, it is not possible to fully make use of excellent toughness of tempered martensite structure, thereby resulting in deterioration of high toughness of a product steel pipe.

While martensite structure is capitalized in a steel pipe of low alloy steel or medium alloy steel as described above, a martensitic stainless steel pipe, which can easily achieve high strength, is widely used in the field of a stainless steel pipe as well for various applications for which strength and corrosion resistance are required. Particularly in recent years, from energy-related circumstances, martensitic stainless steel pipes are extensively used as oil well country goods for collecting oil and natural gas.

That is, the environment of wells (oil wells) for collecting oil and natural gas has become more and more hostile in recent years, and in addition to the increase of pressure associated with the increase of drilling depth, the number of wells which contain significant amounts of corrosive components such as wet carbon dioxide gas, hydrogen sulfide, and chlorine ions have been increasing. Accordingly, while the increase of the strength of material is demanded, corrosion of the material due to corrosive components as described above and embrittlement caused thereby have become an issue, and thus there is a growing demand for oil well pipes having excellent corrosion resistance.

Under such circumstances, martensitic stainless steels are widely used in environments containing wet carbon dioxide gas of relatively low temperature, since the martensitic stainless steel has excellent resistance to carbon dioxide gas corrosion although it may not have sufficient resistance to sulfide stress corrosion cracking caused by hydrogen sulfide. Typical examples thereof include an oil well pipe of 13Cr type steel (having a Cr content of 12 to 14%) of L80 grade specified by API (American Petroleum Institute).

Generally, it is common to apply quenching and tempering treatments for the martensitic stainless steel, and the 13Cr steel of API L80 grade is no exception. However, since the 13Cr steel has a martensitic transformation starting temperature (Ms point) of about 300° C., which is lower than that of low alloy steel, and has a large hardenability, it exhibits high susceptibility to quench cracking.

Particularly, when a tubular steel product is quenched, it exhibits a very complex stress state, compared with the case of a sheet/plate or bar material, and when it is subjected to water cooling, quench cracking occurs; therefore, it is necessary to adopt a process with a slow cooling rate such as cooling in air (natural air cooling), forced air cooling, and slow mist cooling. For this reason, in the production of the 13Cr-type oil well pipe of L80 grade, air quenching is performed to prevent quench cracking. Since this type of alloy steel has a large hardenability, martensitization can be achieved even when the cooling rate at the time of the quenching treatment is slow.

However, although this method can be effective in preventing quench cracking, problems arise such that the productivity is low since the cooling rate is slow, and besides, various properties including the resistance to sulfide stress-corrosion cracking deteriorate.

In this way, even in a steel pipe of low alloy steel or medium alloy steel, or further in a martensitic stainless steel pipe, there is a problem of quench cracking in a quenching treatment, and thus there is a greater need for solving this problem particularly in a steel pipe, compared with a sheet/plate material and a bar material.

Conventionally, there have been proposed several techniques to solve such a quench cracking problem. For example, Patent Literature 1 discloses, as a method for preventing quench cracking of a steel pipe containing 0.2 to 1.2% of C, a method for quenching a steel pipe made of a medium or high carbon type of steel, in which cooling in a quenching process is performed only from an inner surface of the steel pipe, and whenever necessary, the steel pipe is rotated during cooling.

In the literature, it is suggested that: when the outer surface of the steel pipe is rapidly cooled, martensitic transformation of the outer surface precedes, and the brittle martensite structure of the outer surface cannot withstand the transformation stress due to a delayed martensitic transformation of the inner surface, thus leading to quench cracking; and it is possible to appropriately countervail the transformation stress and the thermal stress by cooling the steel pipe from the inner surface. However, there is a problem that performing the cooling of the inner surface of a steel pipe involves technical difficulties compared with the cooling of the outer surface.

Patent Literature 2 discloses, as a method for producing a steel pipe having a microstructure principally composed of martensite by applying quenching and tempering treatments for a Cr-based stainless steel pipe containing 0.1 to 0.3% of C and 11.0 to 15.0% of Cr, a method for producing a martensitic stainless steel pipe in which the steel pipe is quenched at an average cooling rate of not less than 8° C./sec in a temperature range from Ms point to Mf point (temperature at which martensitic transformation ends) when performing the quenching treatment, and thereafter the steel pipe is subjected to the tempering treatment. By ensuring the above-described cooling rate, it is possible to prevent the formation of retained austenite, thereby obtaining a microstructure principally composed of martensite.

However, in order to prevent quench cracking even in rapid cooling such as water quenching, the production method of Patent Literature 2 requires that cooling be performed only from the inner surface of a steel pipe, and further, as needed, the steel pipe be rotated, so that a problem similar to that of the quenching method according to Patent Literature 1 arises when put into commercial use.

Patent Literature 3 discloses a method for producing a martensitic stainless steel pipe, in which a stainless steel pipe containing 0.1 to 0.3% of C and 11 to 15% of Cr is quenched by performing a two-stage cooling to obtain a microstructure of which not less than 80% is martensite, and thereafter the stainless steel pipe is tempered, where the two-stage cooling consists of: a first cooling in which air cooling is performed from a quenching onset temperature until when the outer surface temperature becomes any temperature lower than "Ms point—30° C." and higher than "an intermediate temperature between Ms point and Mf point"; and thereafter a second cooling in which rapid controlled cooling of the pipe outer surface is performed through a temperature range until the outer surface temperature becomes Mf point or lower, so as to ensure an average cooling rate of the pipe inner surface to be not less than 8° C./sec.

The method described in Patent Literature 3 is a method to prevent quench cracking by relatively reducing the cooling rate in the first cooling, and to suppress the formation of retained austenite by the rapid controlled cooling of the pipe outer surface in the second cooling. However, when the wall thickness is heavy, it is difficult to control the cooling rate of the pipe inner surface by cooling the outer surface.

Moreover, Patent Literature 4 discloses, as a method for producing a seamless steel pipe of low alloy steel containing a medium or high level of carbon of C: 0.30 to 0.60%, a method for performing water cooling down to a temperature range of 400 to 600° C. immediately after hot rolling, and after the end of water cooling, performing isothermal transformation heat treatment (austemper process) in a furnace heated to 400 to 600° C. However, the microstructure of the steel pipe which is produced by the isothermal transformation heat treatment according to Patent Literature 4 is bainite which generally has lower strength than martensite, and therefore it may not be able to cope with a case where a high strength is required.

CITATION LIST

Patent Literature

Patent Literature 1: Japanese Patent Application Publication No. 9-104925

Patent Literature 2: Japanese Patent Application Publication No. 8-188827

Patent Literature 3: Japanese Patent Application Publication No. 10-17934

Patent Literature 4: Japanese Patent Application Publication No. 2006-265657

SUMMARY OF INVENTION

Technical Problem

As described above, when a medium or high carbon type of steel pipe (a steel pipe of low alloy steel or medium alloy steel) is quenched to obtain a high strength martensite structure, performing rapid cooling such as water quenching is likely to cause quench cracking. If a moderate cooling such as oil quenching is performed to avoid quench cracking, a sufficient amount of martensite structure cannot be obtained, thereby leading to degrade strength/toughness of the steel pipe.

Moreover, when producing a martensitic stainless steel pipe, although it is possible to obtain martensite structure even if the cooling rate is moderately slow at the time of a quenching treatment, the productivity is low due to the slower cooling rate, and various properties including resistance to sulfide stress-corrosion cracking deteriorate. If water quenching is performed to improve the productivity, quench cracking occurs.

The present invention has been made in view of the above-described problems, and has its object to provide a method for quenching a steel pipe which can be effective in preventing quench cracking in a medium or high carbon type of steel pipe (a steel pipe mostly of low alloy steel or medium alloy steel) or martensitic stainless steel.

Solution to Problem

The summaries of the present invention are as follows.

(1) A method for quenching a steel pipe by water cooling from an outer surface thereof, wherein pipe end portions avoid water cooling, and at least part of a main body other than the pipe end portions is subjected to water cooling.

(2) The method for quenching a steel pipe according to (1), wherein a region(s) that is not subjected to direct water cooling over an entire circumference thereof is provided along an axial direction at least in part of the main body other than the pipe end portions.

(3) The method for quenching a steel pipe according to (1) or (2), wherein the start and stop of water cooling are intermittently repeated at least in part of a quenching process.

(4) The method for quenching a steel pipe according to (1) or (2), wherein in order to perform water cooling for an outer surface of the steel pipe, an intensified water cooling is performed in a temperature range in which temperature of the outer surface of the steel pipe is higher than Ms point, thereafter switched to a moderate water cooling or air cooling to forcedly cool down the outer surface to Ms point or lower.

(5) The method for quenching a steel pipe according to any of (1) to (4), wherein the steel pipe contains 0.2 to 1.2% of C.

(6) The method for quenching a steel pipe according to any of (1) to (4), wherein the steel pipe is a Cr-based stainless steel pipe containing 0.10 to 0.30% of C and 11 to 18% of Cr.

Advantageous Effects of Invention

According to the method for quenching a steel pipe of the present invention, it is possible to subject a medium or high carbon type of steel pipe (a steel pipe mostly of low alloy steel or medium alloy steel) or a Cr-based stainless steel pipe to a quenching treatment by use of rapid cooling means (water quenching) without causing quench cracking. This allows stable production of a high-strength steel pipe having a microstructure with a high martensite ratio (specifically, a martensite ratio being not less than 80%).

DESCRIPTION OF EMBODIMENTS

Figure 1:
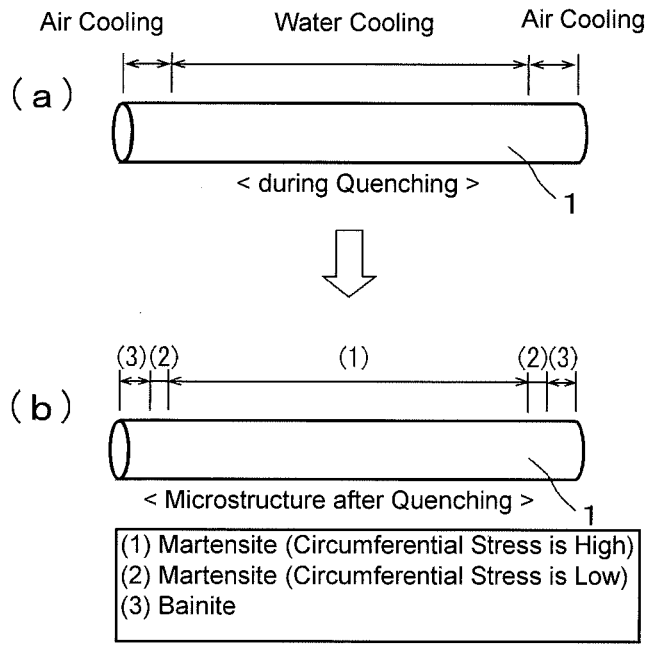
FIG. 1 is a diagram to explain a method for quenching a steel pipe of the present invention, in which (a) is a diagram to show a cooling method at the time of a quenching treatment, and (b) is an explanatory diagram of a microstructure after the quenching treatment (where the case of a low alloy steel is exemplified).

To solve the above-described problems, the present inventors have repeated experiments of water cooling in which steel-pipe test specimens made of low alloy steel containing a high level of carbon and Cr-based stainless steel were heated to not less than $A_{r3}$ transformation point temperature, and the steel pipe was subjected to water cooling from the outer surface. As a result of that, the following findings (a) to (f) have been obtained.

(a) When the entire steel pipe is cooled to not more than martensitic transformation finish temperature (Mf point) by an intensified water quenching, there is a high probability that quench cracking occurs.

(b) Since a crack at the time of quench cracking extends roughly in an axial direction of the steel pipe, it is inferred that primary stress to develop the crack is tensile stress in a circumferential direction.

(c) The cause of the generation of the tensile stress in a circumferential direction is possibly attributable to the lag of the timing of martensitic transformation between on the outer surface side and on the inner surface side because a temperature difference (temperature unevenness) along the wall thickness-wise direction occurs in the cooling procedure.

(d) Particularly in the vicinity of cooled surface where temperature unevenness is large (that is, temperature difference from the inner surface side is large), a microcrack due to brittle fracture is likely to occur, and this tends to be an initiation point of crack propagation.

(e) A fissure, in most cases, develops from an end portion of a steel pipe as the initiation point. This is presumably because a stress intensity factor at an end portion with a free surface is larger than that in any portion other than the end portions.

(f) When water cooling is not employed so as to suppress a cooling rate, quench cracking does not occur either in the case of low alloy steel containing a high level of carbon or Cr-based stainless steel. Note that in a low alloy steel containing a high level of carbon, martensitization is suppressed and a microstructure principally composed of bainite is obtained, so quench cracking does not occur.

In short, quench cracking is attributed in most cases to the consequence that a fissure generated at an end portion with a free surface of a steel pipe and acting as an initiation point of the crack is subjected to tensile stress (hereafter, "tensile stress" is also simply referred to as "stress") in a circumferential direction due to thermal stress and transformation stress, the thermal stress being caused by temperature unevenness in a wall thickness-wise direction, the temperature unevenness occurring in the cooling procedure, and propagates via microcracks which occur in the vicinity of the cooled surface.

The present inventors further calculated the maximum stress generated in a circumferential direction of a steel pipe by an FEM (finite element method) analysis, taking thermal stress and transformation stress into account. In this FEM analysis, it is assumed that the steel pipe is uniformly cooled in an axial direction thereof, and a generalized plane strain model is applied to analyze a two-dimensional cross section of the steel pipe.

Figure 9:
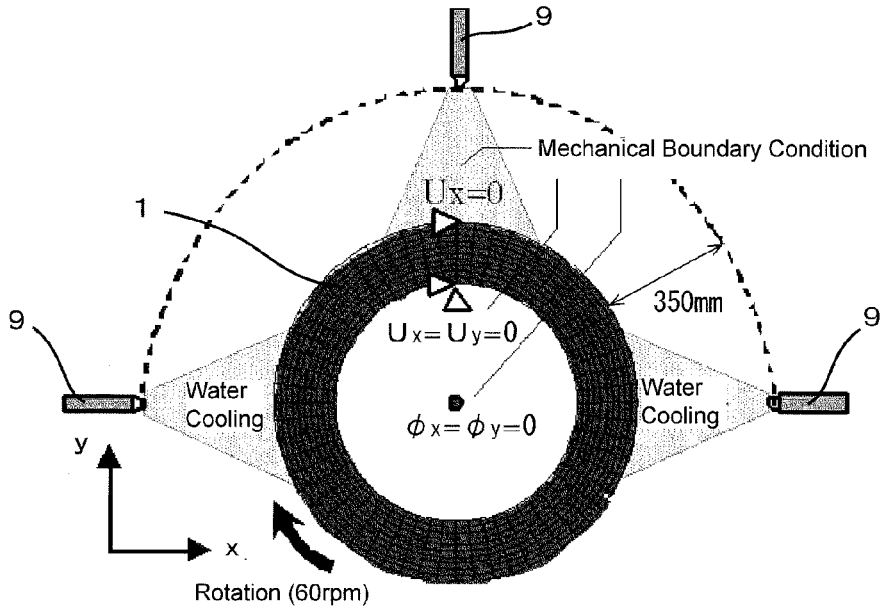
FIG. 9 is a diagram to show an FEM analysis model for the analysis of a two-dimensional cross section of the steel pipe.

FIG. 9 is a diagram to show an FEM analysis model for the analysis of a two-dimensional cross section of a steel pipe. In the calculation with this model, as shown in the figure, it was assumed that the steel pipe is taken out from a furnace to the outside at 920° C. and, after 50 seconds elapse (taking the preparation time for cooling etc. in consideration), the outer surface of the steel pipe 1 (C: 0.6%) is subjected to water cooling from three directions by use of air-cum-water nozzles 9, and the inner surface is cooled by air blow. Although the heat transfer coefficient of the outer surface of the steel pipe 1 varies depending on temperature, it was assumed to be 12700 W/($m^2$·K) at maximum.

Figure 10:
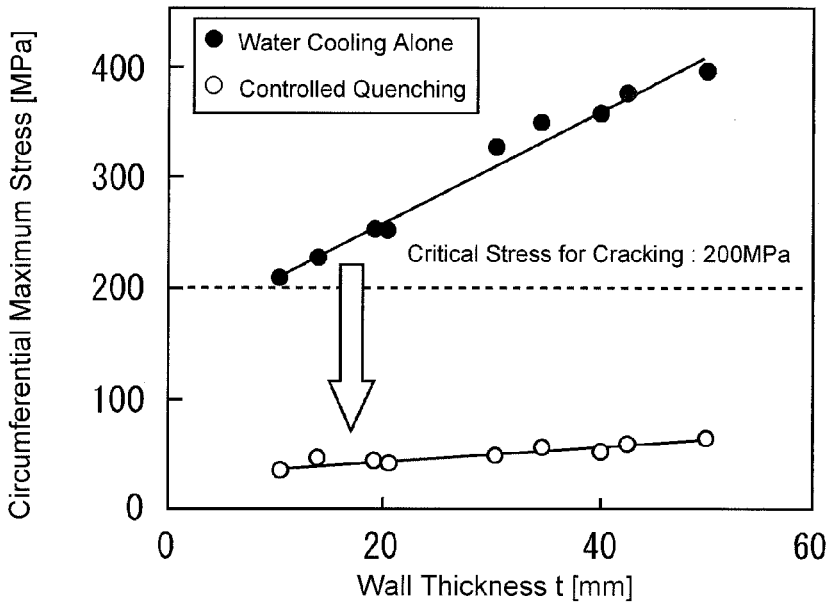
FIG. 10 is a diagram to show the relationship between a circumferential maximum stress and the wall thickness of a steel pipe, which is the analysis result by the FEM analysis model for analyzing a two-dimensional cross section of the steel pipe.

FIG. 10 is a diagram to show the relationship between a circumferential maximum stress and the wall thickness of a steel pipe, which is the analysis result by the model. In the figure, the symbol ● (water cooling alone) shows a case in which cooling is performed under the condition in FIG. 9, and the symbol ○ (controlled quenching) shows a case which simulates the cooing state (see FIG. 2 described below) when air cooling is applied for the appropriate regions for water cooling, wherein water is sprayed at a low pressure only from the air-cum-water nozzle disposed above the steel pipe such that the sprayed water stream is not directly injected onto the steel pipe and the stream of air and minute water droplets suspended in it is formed. Moreover, the broken line parallel to the lateral axis in the figure indicates a critical stress below which quench cracking does not occur, and which is 200 MPa in this case.

From the analysis result shown in FIG. 10, it is revealed that when the outer surface of a steel pipe is subjected to water cooling from three directions (symbol ● in the figure), the circumferential maximum stress of the steel pipe exceeds the critical stress for cracking (200 MPa) regardless of wall thickness, and thereby quench cracking occurs; however, if controlled quenching in which air cooling is applied for appropriate regions for water cooling is performed (symbol ○ in the figure), the circumferential maximum stress in the air cooled region can be significantly reduced.

Figure 11:
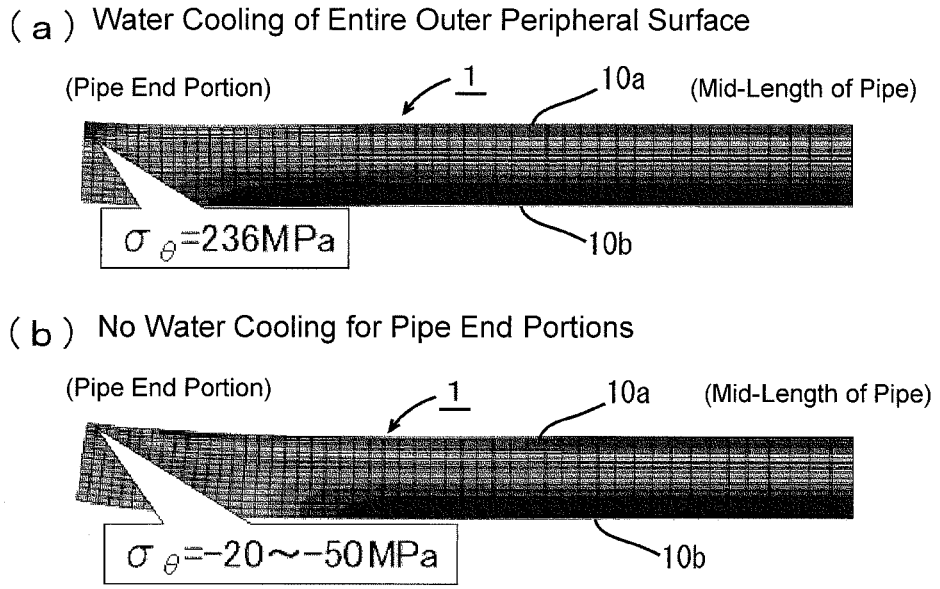
FIG. 11 is a diagram to show the analysis result by an FEM analysis model for analyzing a two-dimensional longitudinal section of a steel pipe, in which (a) shows a case where the entire outer peripheral surface of a steel pipe was water cooled, and (b) shows a case where only a main body other than pipe end portions of a steel pipe was subjected to water cooling.

FIG. 11 is a diagram to show the analysis result by an FEM analysis model for analyzing a two-dimensional longitudinal section of a steel pipe, in which (a) shows a case where the entire outer peripheral surface of a steel pipe was water cooled, and (b) shows a case where only a main body other than end portions of a steel pipe (see FIG. 1 described below) was subjected to water cooling, and the end portions of the steel pipe were not subjected to water cooling. It is to be noted that FIG. 11 represents a half longitudinal section of a steel pipe 1 that is longitudinally sectioned by a plane including the axial center line, in which the plane denoted by reference character 10*a* is an outer surface, and the plane denoted by reference character 10*b* is an inner surface. The heat transfer coefficient of the outer surface of the steel pipe was assumed to be 12,700 W/($m^2$·K) at maximum.

As being evident from FIG. 11, although a large circumferential stress ($\sigma_\theta$=236 MPa) exceeding the critical stress for cracking (200 MPa) is generated at a pipe end portion when the entire outer peripheral surface thereof is subjected to water cooling, such large circumferential stress is not generated when the pipe end portion is not subjected to water cooling.

As so far described, the result of FEM analysis also revealed that it is possible to significantly reduce circumferential stress of the pipe end portions by applying air cooling for the pipe end portions, that is, no water cooling for them.

The present inventors have come up with the following ideas, (g) and (h), from the above-described findings and discussion, eventually completing the present invention:

(g) Even for a steel pipe made of a low alloy steel or medium alloy steel which is prone to occurrence of quench cracking in water quenching, it can be stably water quenched without causing quench cracking, provided that the end portions of the steel pipe are not subjected to water cooling, and the portions other than end portions of steel pipe are subjected to water cooling at a cooling rate which ensures a sufficient martensite ratio, and (h) When the above-described water quenching method is applied to a steel pipe made of martensitic stainless steel, it is possible to ensure high performance without causing quench cracking.

As described so far, the present invention is a method for quenching a steel pipe by water cooling the steel pipe from the outer surface, in which pipe end portions are not subjected to water cooling, and at least part of a main body other than the pipe end portions is subjected to water cooling. It is to be noted that the "pipe end portions" refer to both end portions of a steel pipe.

The reason why the present invention is premised on that the steel pipe is quenched by the water cooling from the outer surface thereof is that compared with the inner surface cooling as described in the aforementioned Patent Literature 1 or 2, the outer surface cooling does not involve technical difficulties, and in the case where a Cr-based stainless steel pipe is a processing object, if it is possible to perform quenching by the water cooling from the outer surface without causing quench cracking, the productivity can significantly be improved.

FIG. 1 is a diagram to explain a method for quenching a steel pipe of the present invention, in which (a) is a diagram to show a cooling method at the time of a quenching treatment, and (b) is an explanatory diagram of a microstructure after the quenching treatment (where the case of a low alloy steel is exemplified). It is to be noted that the water-cooled region of FIG. 1(*a*) corresponds to the portion denoted by reference character (1) of FIG. 1(*b*), and the air-cooled regions of FIG. 1(*b*) corresponds to the portions denoted by reference characters (2) and (3) of FIG. 1(*b*).

In the following description, unless otherwise stated, cases of low alloy steel and medium alloy steel for which a certain cooling rate or more is needed for martensitization will be shown, regarding the metal microstructure to be formed.

Figure 2:
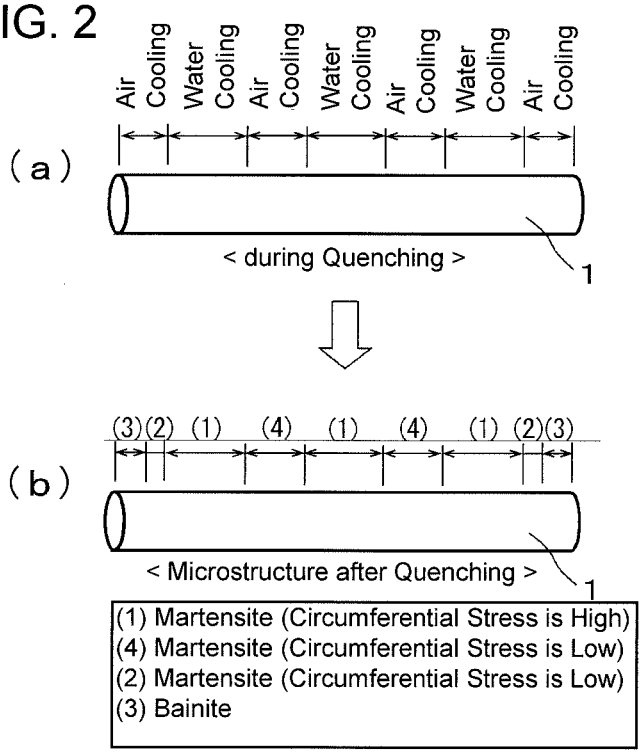
FIG. 2 is a diagram to explain another embodiment of the method for quenching a steel pipe of the present invention, in which (a) is a diagram to show a cooling method at the time of a quenching treatment, and (b) is an explanatory diagram of a microstructure after the quenching treatment (where the case of a low alloy steel is exemplified).

In the present invention, as shown in FIG. 1(*a*), when the steel pipe 1 is subjected to water cooling from the outer surface to be quenched, the pipe end portions are not subjected to water cooling, and at least part of a main body other than the end portions of steel pipe (hereafter, also referred to as a "main body") is subjected to water cooling. Although the entire surface of the main body is subjected to water cooling in the example shown in FIG. 1(*a*), a region(s) that is not subjected to water cooling may be present in the main body as shown in FIG. 2(*a*). This is because, since the region of no water cooling in the main body is adjacent to the water-cooled region, the region of no water cooling is cooled by conduction heat transfer, and undergoes martensitic transformation. The pipe end portions as being not subjected to water cooling are subjected to air cooling, for example, as shown in FIG. 1(*a*). It is to be noted that "air cooling" includes any of cooling in air and forced air cooling.

By adopting such cooling method, a steel micro-structure as shown in FIG. 1(*b*) is obtained after the quenching treatment. That is, since the main body (1) of the steel pipe 1 is subjected to water cooling at a cooling rate that allows the formation of martensite, which is necessary for obtaining required mechanical properties and corrosion resistance, the steel microstructure is a structure principally composed of martensite. Since an end region (3), which is located closer to the pipe end, out of pipe end regions (2) and (3) in the end portion of the steel pipe 1 is not subjected to water cooling and its cooling rate is low, a microstructure principally composed of bainite is formed so that fissure generation and fissure extension in the pipe end portion are suppressed.

In contrast to this, since a pipe end region (2), which is located on the side of the main body, out of the pipe end regions (2) and (3) in the end portion is adjacent to the main body (1) which is subjected to water cooling, the pipe end region (2) is cooled by conduction heat transfer, thereby undergoing martensitic transformation. However, since heat flows principally in an axial direction rather than in a circumferential direction, in the pipe end region (2), the temperature distribution in the wall thickness-wise direction is small compared with in the main body (1), and circumferential stress is low. As a result of that, the pipe end region (2) in the pipe end portion is not likely to cause fissure generation and extension even when martensitic transformation occurs. It is to be noted that since the profile/shape of the pipe end portion as rolled is not exactly cylindrical, it is usually desirable to cut off the pipe end portions by a length of about 150 to 400 mm at a subsequent processing stage. Thus, such pipe end portions which are principally composed of bainite and have a lower martensite ratio can be cut off and removed in a process after the quenching process.

The method for quenching a steel pipe of the present invention is a method of forming martensite structure of steel by quenching, in which the ratio of produced martensite is not specifically limited. However, in low alloy steel and medium alloy steel, generally, if not less than 80% of the structure is martensite, a desired strength can be obtained. When a product to be quenched is a Cr-based stainless steel pipe, although martensite is formed even when the cooling rate is moderately small, the quenching method of the present invention ensures desired corrosion resistance. In any case, the present invention intends to obtain a steel pipe having a martensite ratio of not less than 80%.

The present invention may adopt an embodiment in which a region(s) that is not subjected to direct water cooling over the entire circumference thereof is provided along an axial direction at least in part of a portion (main body of the pipe) other than pipe end portions.

FIG. 2 is a diagram to explain the present embodiment, in which (a) is a diagram to show a cooling method at the time of a quenching treatment, and (b) is an explanatory diagram of a microstructure after the quenching treatment (where the case of a low alloy steel is exemplified). As shown in FIG. 2(*a*), it is configured such that the entire surface of the main body (1) of the steel pipe 1 is not subjected to uniform water cooling, and a water cooled region(s) and a region(s) of no water cooling (air cooled region(s)) are appropriately provided along the longitudinal direction of the steel pipe 1. In this air cooled region(s), the steel pipe is not subjected to direct water cooling over the entire circumference thereof. It is to be noted that the air-cooled region(s) of FIG. 2(*a*) correspond to the region(s) denoted by reference character (4) of FIG. 2(*b*).

This embodiment is particularly effective when, for example, the wall thickness of the steel pipe is thin. When the wall thickness of the steel pipe is thin, as shown in FIG. 1, if the entire surface of the main body (1) is subjected to uniform water cooling, quench cracking may occur as a result of that the strength of the pipe end portions (2) and (3) is not sufficient to withstand the circumferential stress generated in the main body (1).

In such a case, adopting the cooling method shown in FIG. 2(*a*) can realize a quenching process which can be effective in preventing quench cracking while ensuring the martensite ratio in the main body. As shown in FIG. 2(*b*), since the residual stress becomes remarkably small in the air cooled region (4) provided in the main body, it is possible to suppress the crack propagation, and also since both sides adjacent to the air cooled region (4) are subjected to water cooling, thermal conduction to the water cooled region (1) occurs at a sufficient rate, and it is possible to achieve necessary martensite ratio even in the air cooled region (4).

Figure 3:
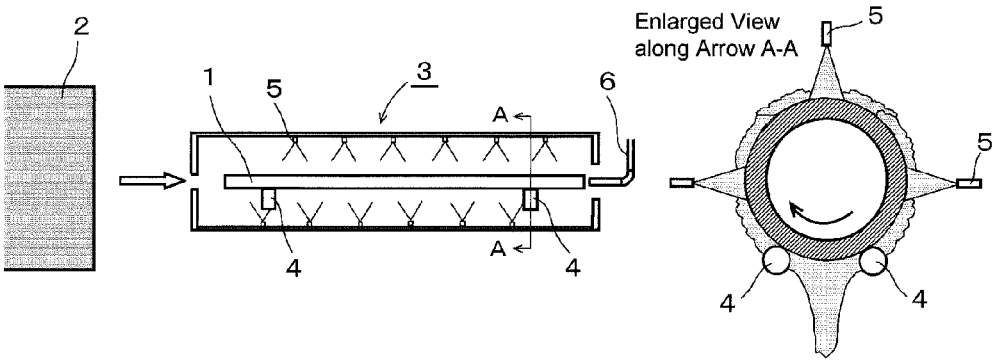
FIG. 3 is a diagram to show an outline configuration example of a principal part of an apparatus which can be used to perform the method for quenching a steel pipe of the present invention.

FIG. 3 is a diagram to show an outline configuration example of a principal part of an apparatus which can perform a method for quenching a steel pipe of the present invention. In FIG. 3, the steel pipe 1 which is conveyed from a heating furnace 2 is conveyed into a cooling apparatus 3, and while being held and rotated by rollers 4, the outer surface of the steel pipe is cooled by water spray injected from nozzles 5 attached to the inside of the apparatus 3. It is to be noted that on one side of the cooling apparatus 3, an air jet nozzle 6 for forcedly air cooling the inner surface of the steel pipe 1 is arranged, as needed.

In the present invention, it is possible to adopt an embodiment in which in order to apply water cooling onto the outer surface of the steel pipe, the start and stop of water cooling are intermittently repeated during at least in part of the quenching process. By adopting an intermittent water cooling scheme, the total water cooling time increases compared with continuous water cooling, and thereby the difference between the inner temperature and the surface temperature decreases, resulting in a decrease in residual stress.

In the present embodiment, it is possible to consistently perform the intermittent water cooling from the initial stage of a quenching treatment in which the temperature of the steel pipe is not less than $A_{r3}$ point until the temperature of the inner and outer surfaces of the steel pipe becomes not more than Ms point, preferably not more than Mf point, and also to use it as part of the quenching process.

The present invention may adopt an embodiment in which in order to apply water cooling onto the outer surface of the steel pipe, an intensified water cooling is performed in a temperature range in which the temperature of the outer surface of the steel pipe is higher than Ms point, thereafter switched to a moderate water cooling or air cooling (including forced air cooling), and after the temperature difference between those of the outer surface of the steel pipe and the inner surface of the steel pipe is decreased, the outer surface is forcedly cooled down to not more than Ms point.

In the cooling method describe above in which the intensified water cooling is switched to the moderate water cooling or air cooling, it is desirable that the intensified water cooling to a temperature near but higher than Ms point is performed, thereafter switched to the moderate water cooling or air cooling; heat recovery is caused to occur in the outer surface side of the steel pipe through thermal conduction from the inner surface side so as to decrease the temperature difference between the inner and outer surfaces of the steel pipe as much as possible; and thereafter cooling to not more than Ms point, preferably not more than Mf point is performed by forced air cooling, etc.

This embodiment is particularly effective, for example, when the wall thickness of the steel pipe is heavy. When the wall thickness of the steel pipe is heavy, temperature unevenness in the wall thickness-wise direction may increase during the water cooling from the outer surface, and brittle fracture may occur which is an initiation point of a crack in the outer surface caused by a large tensile stress due to expansion associated with martensitic transformation in the outer surface. To suppress this, the embodiment is effective in which the start of the martensitic transformation in the outer surface is delayed to reduce the difference between the starting time of martensitic transformation in the inner surface and that in the outer surface.

By the embodiment, it is possible to mitigate the temperature gradient in the wall thickness-wise direction, thereby reducing the tensile stress which occurs in a circumferential direction. Particularly, it is desirable that the temperature difference between the inner and outer surfaces is mitigated before the temperature of the cooled outer surface passes Ms point. In practice, it is desirable to monitor the temperature of the water cooled portion of the outer surface of the steel pipe, and stop the water cooling before the temperature passes Ms point.

As for the cooling rate for an intensified water cooling, although it depends on types of steel, it is desirable to determine an appropriate cooling rate based on a CCT diagram of the target steel, since in the case of a low alloy steel, when the cooling rate in the initial cooling stage is too slow, bainite transformation occurs and it becomes impossible to ensure a sufficient martensite ratio.

It is to be noted that in the embodiment of the present invention, which includes a cooling process in which an intensified water cooling is performed down to a temperature near but higher than Ms point, thereafter switched to a moderate cooling or air cooling, and heat recovery is caused to occur in the outer surface side of the steel pipe through thermal conduction from the inner surface side so as to decrease the temperature difference between the inner and outer surfaces of the steel pipe as much as possible, it is also possible to achieve similar effects by using, instead of this cooling process, the previously-described intermittent cooling.

That is, in the present invention, the intermittent water cooling (operation to intermittently repeat the start and stop of water cooling) according to the present invention (3) may also be suspended at a temperature near but higher than Ms point, and thereafter an intensified cooling such as forced air cooling may be performed. However, this embodiment belongs to the category of the present invention (3).

In the method for quenching a steel pipe of the present invention described so far, as the scheme of water cooling, conventionally used schemes such as laminar cooling, jet cooling, mist cooling, and the like may be appropriately adopted. On top of that, it is desirable to make temperature deviation in the wall thickness-wise direction smaller by increasing/decreasing the amount of water during water cooling, or intermittently repeating the start and stop of water cooling, thereby reducing the circumferential stress of the steel pipe. It is desirable that the inside of steel pipe is naturally cooled in the air or forcedly air cooled instead of water cooling. Moreover, it is desirable to keep rotating the steel pipe during water cooling since thereby the temperature distribution in the circumferential direction can be made uniform.

The product to be processed by the present invention is a steel pipe which is likely to cause quench cracking at the time of a quenching treatment. In particular, the effect of the present invention is remarkably exhibited when the product to be processed by the present invention is (A) a steel pipe containing 0.20 to 1.20% of C, and among others, a steel pipe of low alloy steel or medium alloy steel, or (B) a Cr-based stainless steel pipe containing 0.10 to 0.30% of C and 11 to 18% of Cr, and among others a 13Cr stainless steel pipe.

The steel pipe of the above-described (A) containing 0.20 to 1.20% of C is a steel pipe made of a material in which C is contained in this range, and is generally a steel pipe of low alloy steel or medium alloy steel. When the content of C is less than 0.20%, quench cracking hardly becomes a problem since the volume expansion due to martensitization is relatively small.

On the other hand, when C is more than 1.20%, Ms point becomes lower, and retained austenite is likely to occur so that obtaining a microstructure having a martensite percentage of not less than 80% becomes difficult. Therefore, a C content of 0.20 to 1.20% is desirable so that the present invention exhibits its effects. The C content is more desirably 0.25 to 1.00%, and furthermore desirably 0.3 to 0.65%.

In a steel pipe of low alloy steel or medium alloy steel containing 0.20 to 1.20% of C, as shown in FIG. 1 described above, it is possible to make the vicinity of a pipe end have a microstructure principally composed of bainite without quench cracking, by applying water cooling onto the entire main body other than end portions of the steel pipe and by avoiding water cooling for the pipe end portions.

Examples of low alloy steel or medium alloy steel include, for example, a steel consisting of C: 0.20 to 1.20%, Si: 2.0% or less, Mn: 0.01 to 2.0%, and one or more elements selected from a group consisting of Cr: 7.0% or less, Mo: 2.0% or less, Ni: 2.0% or less, Al: 0.001 to 0.1%, N: 0.1% or less, Nb: 0.5% or less, Ti: 0.5% or less, V: 0.8% or less, Cu: 2.0% or less, Zr: 0.5% or less, Ca: 0.01% or less, Mg: 0.01% or less, B: 0.01% or less, the balance being Fe and impurities, the impurities being P: 0.04% or less and S: 0.02% or less. It is to be noted that when the Cr content is more than 7.0%, martensite is likely to be formed even in the pipe end portions which are not subjected to water cooling, and therefore the Cr content is desirably not more than 7.0%.

Next, the Cr-based stainless steel pipe of the above-described (B) containing 0.10 to 0.30% of C and 11 to 18% of Cr is a steel pipe (martensitic stainless steel pipe) made of Cr-based stainless steel in which C and Cr are contained in this range. When the content of C is less than 0.10%, it is not possible to achieve sufficient strength even if quenching is performed, and on the other hand, when C is more than 0.30%, it is unavoidable that the austenite is retained, and it becomes difficult to ensure a martensite ratio of not less than 80%. Therefore, the C content of 0.10 to 0.30% is desirable so that the present invention exhibits its effects.

The reason why the content of Cr is 11 to 18% is that in order to improve corrosion resistance, Cr of 11% or more is desirable, and on the other hand, when Cr is more than 18%, δ-ferrite is likely to be generated, thereby reducing hot workability. More desirably, Cr is 10.5 to 16.5%.

Examples of Cr-based stainless steel containing 0.10 to 0.30% of C and 11 to 18% of Cr include, for example, a steel consisting of C: 0.10 to 0.30%, Si: 1.0% or less, Mn: 0.01 to 1.0%, Cr: 11 to 18% (more desirably, 10.5 to 16.5%), and one or more elements selected from a group consisting of Mo: 2.0% or less, Ni: 1.0% or less, Al: 0.001 to 0.1%, N: 0.1% or less, Nb: 0.5% or less, Ti: 0.5% or less, V: 0.8% or less, Cu: 2.0% or less, Zr: 0.5% or less, Ca: 0.01% or less, Mg: 0.01% or less, B: 0.01% or less, the balance being Fe and impurities, the impurities being P: 0.04% or less and S: 0.02% or less. Among others, 13Cr stainless steel pipes are conventionally used in many industrial areas and are suitable as the object to be processed by the present invention.

The quenching method of the present invention is applicable, as a matter of course, to so-called quenching accompanied by reheating, which is performed by reheating a steel pipe from ambient temperature, as well as to so-called direct quenching in which a steel pipe immediately after hot rolling is quenched from a state where the temperature of the steel pipe is not less than $A_{r3}$ point during the production of a seamless steel pipe, and further to a quenching method for so-called inline heat treatment (inline quenching) in which the steel pipe is soaked (complementarily heated) at a temperature not less than $A_3$ point in a stage in which the heat retained by the steel pipe is not significantly decreased after hot rolling, and is thereafter quenched. Since according to the quenching method of the present invention, quench cracking can be effectively prevented, it is possible to stably produce a high-strength steel pipe having a microstructure with a high martensite ratio.

EXAMPLES

A tubular test material was cut out from a seamless steel pipe of the material shown in Table 1, and quenched under various cooling conditions to observe the presence or absence of quench cracking, and steel micro-structure. In Table 1, steel type A is a low alloy steel, and steel type B is a high Cr steel (martensitic stainless steel).

TABLE 1

| Steel | Chemical composition of specimen (unit: %, the balance being Fe and impurities) | | | | | | | | |
|---|---|---|---|---|---|---|---|---|---|
| Type | C | Si | Mn | P | S | Cu | Cr | Ni | Mo |
| A | 0.6100 | 0.1967 | 0.4500 | 0.0135 | 0.0007 | — | 1.01 | — | 0.6917 |
| B | 0.1900 | 0.2267 | 0.5833 | 0.0123 | 0.0005 | 0.0100 | 12.67 | 0.1267 | 0.0100 |

| Steel | Chemical composition of specimen (unit: %, the balance being Fe and impurities) | | | | | | | | |
|---|---|---|---|---|---|---|---|---|---|
| Type | Ti | V | Nb | Al | Sn | As | B | Ca | N |
| A | 0.0080 | 0.1017 | 0.0277 | 0.0322 | — | — | — | — | 0.0037 |
| B | 0.0013 | 0.0700 | 0.0010 | 0.0027 | 0.0010 | 0.0030 | 0.0001 | 0.0005 | 0.0278 |

The configuration of the test material was a straight pipe having an outer diameter of 114 mm, a wall thickness of 15 mm, and a length of 300 mm. This test material was heated to a temperature about 50° C. higher than the $A_{c3}$ point by an electric heating furnace, held for about 15 minutes, and thereafter carried from the furnace to be conveyed to a cooling apparatus within 30 seconds to start water cooling.

Figure 4:
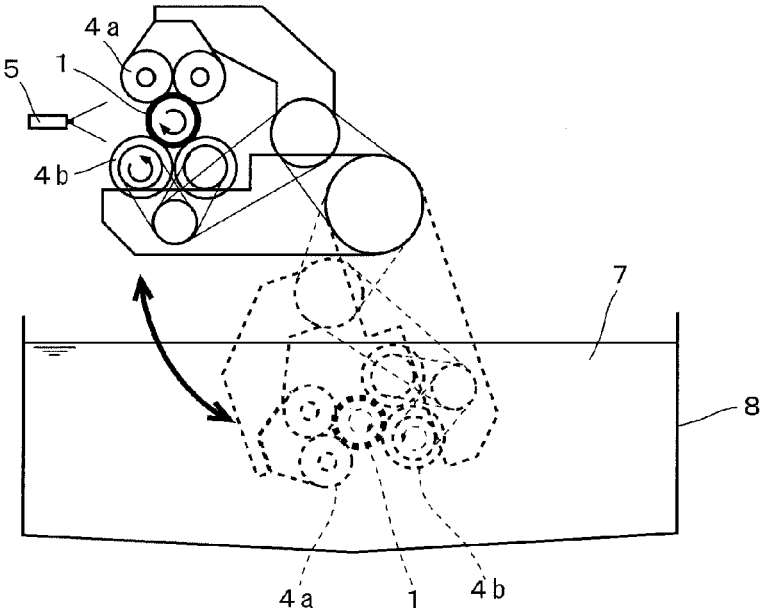
FIG. 4 is a diagram to show an outline configuration of the cooling apparatus used in EXAMPLES.

FIG. 4 is a diagram to show an outline configuration of the cooling apparatus used for the test. This cooling apparatus is configured, as shown by an arrow in the figure, to be able to select a desired method between a method of quenching a steel pipe 1 by a water spray injected from nozzles 5 and a method of quenching the steel pipe 1 by immersing it in a water tank 8 filled with water 7 (shown by broken lines in the same figure). In the quenching by the water spray, the amount of water of spray to be injected can be varied by a flow regulating valve (not shown). The steel pipe 1 was held by lower rollers 4*b* and upper rollers 4*a*. A lid for preventing water intrusion was attached to each end of the steel pipe 1, and only the outer surface was cooled. During cooling, the steel pipe 1 was rotated at 60 rpm by the lower rollers 4*b*.

Table 2 shows water cooling conditions. In Table 2, at water cooling condition A, the inner surface temperature of a main body of the steel pipe was measured by a thermocouple adhered by welding to the inner wall of the steel pipe. Moreover, at water cooling conditions B to E, the outer surface temperature of the main body of steel pipe, or the main body of steel pipe and both left and right end portions of the steel pipe was measured by a thermotracer.

TABLE 2

| | Test | Water cooling condition | Water cooling region |
|---|---|---|---|
| Prior art art example | No. 1 | A: Cooling down to ambient temperature by immersion water cooling | Entire length (No water intrusion into the pipe inner surface) |
| | No. 2 | C: Cooling down to ambient temperature by intermittent spray water cooling | |
| Inventive Example of the present invention | No. 3 | B: Cooling down to ambient temperature by spray water cooling | Main body alone (Except the pipe end portions) (No water intrusion into the pipe inner surface) |
| | No. 4 | C: Cooling down to ambient temperature by intermittent spray water cooling | |
| | No. 5 | E: By switching intensified cooling to moderate cooling by increasing/decreasing the amount of water in a temperature range higher than Ms point and cooling down to 700° C., by spray water cooling, and thereafter cooling down to ambient temperature by forced air cooling | |

Table 3 shows the observation results of the presence or absence of quench cracking and steel micro-structure.

TABLE 3

| | | Steel type A | | Steel type B | |
|---|---|---|---|---|---|
| | Test | Presence or absence of quench cracking | Martensite structure (volume %) | Presence or absence of quench cracking | Martensite structure (volume %) |
| Prior art example | No. 1 | Present | 90% or more | Present | 90% or more over entire length |
| | No. 2 | Present | 90% or more | Present | |
| Inventive Example of the present invention | No. 3 | Absent | 90% or more | Absent | |
| | No. 4 | Absent | 90% or more | Absent | |
| | No. 5 | Absent | 80% or more | Absent | |

Note)
For No. 3 to 5 of steel type A, the pipe ends had principally of bainite structure.

Figure 5:
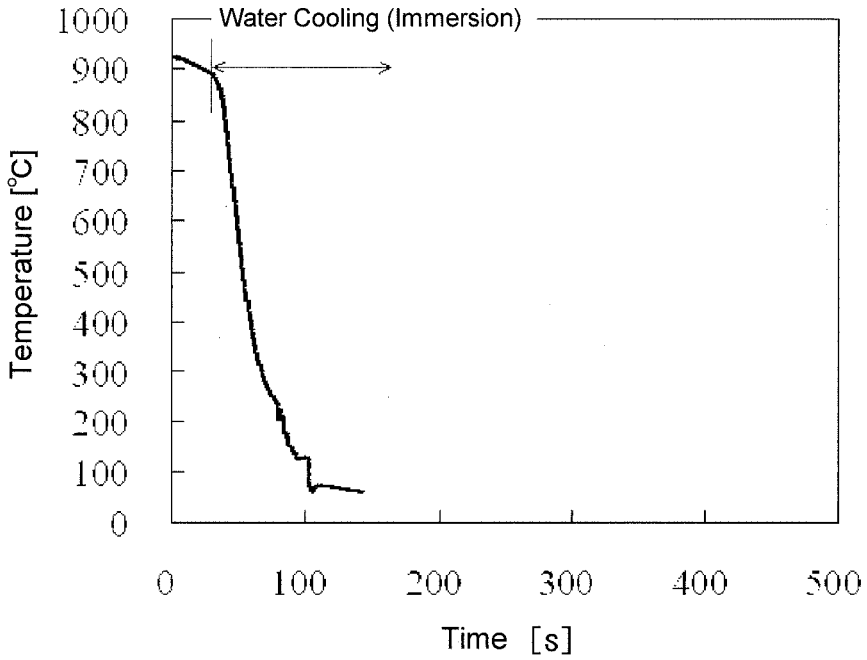
FIG. 5 is a diagram to show measurement results of the inner surface temperature of a main body other than pipe end portions for a steel pipe when the entire length of the steel pipe made of low alloy steel was cooled under the water cooling condition of Test No. 1 of Table 2.

FIG. 5 is a diagram to show measurement results of the inner surface temperature of a main body of a steel pipe of steel type A (low alloy steel) when the entire length of the steel pipe was cooled under the water cooling condition A (immersion water cooling) of test No. 1 of Table 2. Under this water cooling condition, the inner surface temperature of the steel pipe rapidly declined. In this case, although martensite structure of not less than 90% in volume ratio was obtained as shown in Table 3, quench cracking occurred.

Figure 6:
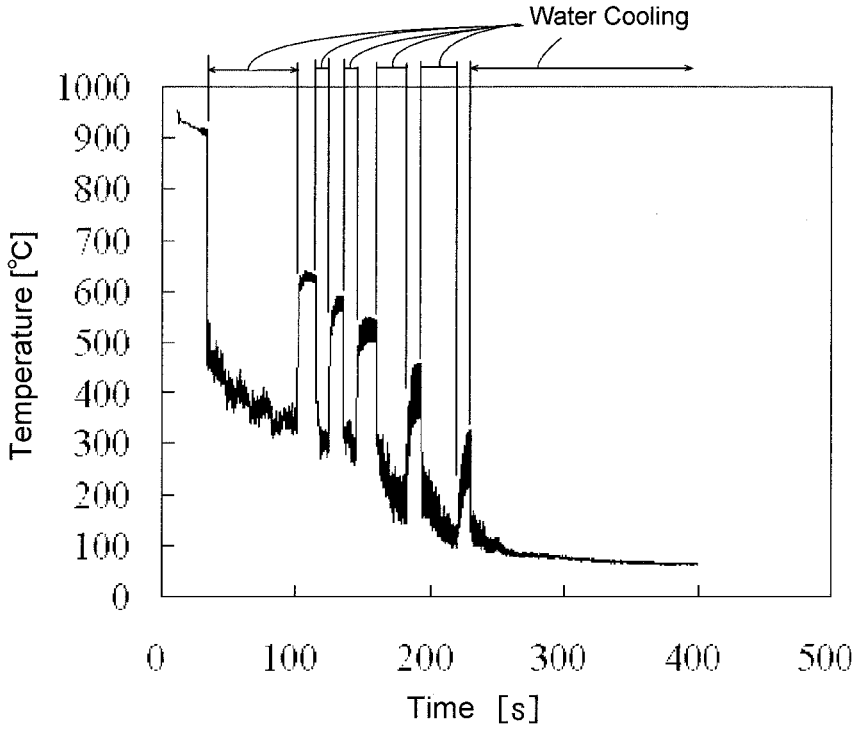
FIG. 6 is a diagram to show measurement results of the outer surface temperature of a main body other than pipe end portions for a steel pipe when the entire length of the steel pipe made of low alloy steel was cooled under the water cooling condition of Test No. 2 of Table 2.

FIG. 6 is a diagram to show measurement results of the outer surface temperature of a main body of a steel pipe of steel type A when the entire length or part of the steel pipe was cooled under the water cooling condition C (intermittent spray water cooling) of Test Nos. 2 and 4 of Table 2. It is seen that under this water cooling condition, the outer surface temperature went up due to heat recovery by thermal conduction from the inner surface whenever water cooling was stopped. In this case as well, martensite structure was not less than 90% in volume ratio. Although quench cracking occurred in No. 2 in which the entire length of the steel pipe was cooled, no quench cracking occurred in No. 4 in which the pipe ends were not subjected to water cooling (see Table 3).

Figure 7:
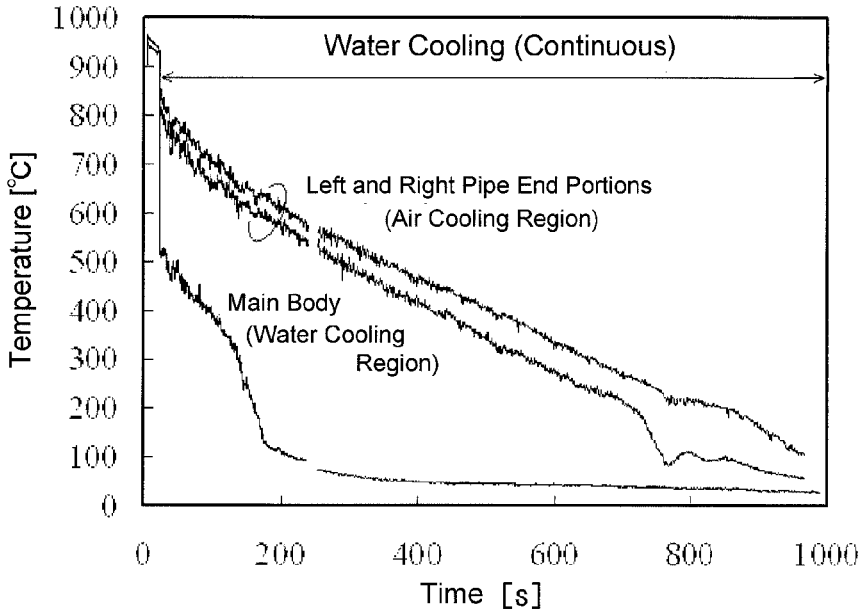
FIG. 7 is a diagram to show measurement results of the outer surface temperature of a main body other than pipe end portions for a steel pipe and both left and right end portions of the steel pipe when only the main body of the steel pipe made of low alloy steel was cooled under the water cooling condition of Test No. 3 of Table 2.

FIG. 7 is a diagram to show measurement results of the outer surface temperature of a main body and both left and right end portions of a steel pipe of steel type A when only the main body of the steel pipe was cooled under the water cooling condition B (spray water cooling) of Test No. 3 of Table 2. Under this water cooling condition, the outer surface temperature generally went down monotonously in both the main body and the end portions. In this case, as shown in Table 3, martensite structure was not less than 90% in volume ratio, and no quench cracking was recognized. The reason for this is considered to be that since the pipe end portions were not subjected to water cooling so that the temperature deviation in the wall thickness-wise direction was small and the circumferential stress was small in the pipe end portions compared with in the main body, a fissure which acts as an initiation point of quench cracking did not occur, even though martensitic transformation occurred.

Figure 8:
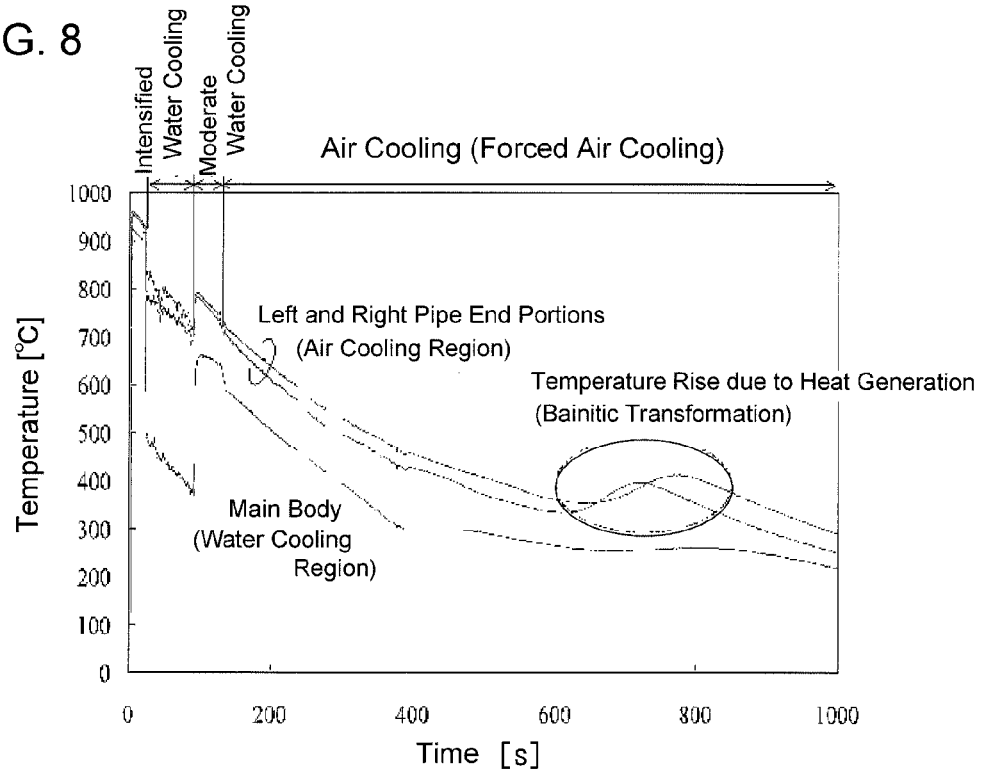
FIG. 8 is a diagram to show measurement results of the outer surface temperature of a main body other than pipe end portions of a steel pipe and both left and right end portions of the steel pipe when only the main body of the steel pipe made of low alloy steel was cooled under the water cooling condition of Test No. 5 of Table 2.

FIG. 8 is a diagram to show measurement results of the outer surface temperature of a main body and both left and right end portions of a steel pipe of steel type A when only the main body of the steel pipe was cooled under the water cooling condition E (switched from intensified water cooling to moderate water cooling during spray water cooling, and thereafter forced air cooling was performed) of Test No. 5 of Table 2. Under this water cooling condition, as shown in Table 3, martensite structure of not less than 80% in volume ratio was obtained, and furthermore no quench cracking was discerned.

The reason for this is considered to be that in the main body of the steel pipe, martensitization progressed in a state in which the temperature difference between the inner and outer surfaces was mitigated as a result of intensified water cooling followed by moderate water cooling being performed in a temperature range higher than Ms point, and in the pipe end portions, bainite was formed because water cooling was not performed, so that occurrence of a fissure which acts as an initiation point of quench cracking was suppressed. While the formation of bainite in the pipe end portions were recognizable due to a temporary temperature rise possibly caused by bainitic transformation at around 400° C. shown in FIG. 8, a Rockwell hardness test (HRC hardness measurement) after cooling and microscopic observation also confirmed that the pipe end portions had a microstructure principally composed of bainite.

It is to be noted that from FIG. 8, in the cooling pattern of the main body of the steel pipe, heat generation which was recognized in the pipe ends and was possibly caused by bainitic transformation in the air cooling process, was not observed.

Although a description has been provided so far regarding the case in which the steel pipe of steel type A was cooled, in the case in which a steel pipe of steel type B (high Cr steel) was cooled, the micro-structure was composed of martensite of not less than 90% in volume ratio under any of the water cooling conditions of Test Nos. 1 to 5 as shown in Table 3. However, in Test Nos. 1 and 2 in which the entire steel pipe was subjected to water cooling, quench cracking occurred since rapid martensitization occurred even in the pipe end portions.

It is to be noted that since the steel type B was a material capable of martensitization even by slow cooling, heat generation around 400° C. (see FIG. 8) in the pipe end portions was not recognized even when the cooling method of Test No. 5 was applied. Regarding quench cracking, in the case of steel type B as well, although quench cracking occurred in the quenching method of Test Nos. 1 and 2, no quench cracking was discerned in Test Nos. 3 to 5 according to the present invention.

From the test results described so far, it can be confirmed that a microstructure principally composed of martensite can be obtained without occurrence of quench cracking by applying the method for quenching a steel pipe of the present invention.

INDUSTRIAL APPLICABILITY

Since the method for quenching a steel pipe of the present invention will not cause quench cracking even when applied to a steel pipe made of a medium or high carbon type of steel (a steel pipe of low alloy steel or medium alloy steel) or a Cr-based stainless steel pipe, which is likely to cause quench cracking, it can be suitably utilized for the quenching treatment of those steel pipes.

REFERENCE SIGNS LIST

1: Steel pipe, 2: Heating furnace, 3: Cooling apparatus,
4: Roller, 4*a*: Upper roller, 4*b*: Lower roller,
5: Nozzle, 6: Air supply pipe, 7: Water, 8: Water tank,
9: Air-cum-water nozzle, 10*a*: Outer surface, 10*b*: Inner surface

What is claimed is:

1. A method for quenching a steel pipe by water cooling from an outer surface thereof, wherein subjecting pipe end portions to air cooling from outer surfaces of the pipe end portions when at least part of a main body other than the pipe end portions is subjected to water cooling from an outer surface of the main body, and the pipe end portions are not subject to water cooling during the subjecting step.

2. The method for quenching a steel pipe according to claim 1, wherein a region(s) that is not subjected to direct water cooling over an entire circumference thereof is provided along an axial direction at least in part of the main body other than the pipe end portions.

3. The method for quenching a steel pipe according to claim 2, wherein the steel pipe contains 0.2 to 1.2% of C in mass %.

4. The method for quenching a steel pipe according to claim 2, wherein the steel pipe is a Cr-based stainless steel pipe containing, in mass %, 0.10 to 0.30% of C and 11 to 18% of Cr.

5. The method for quenching a steel pipe according to claim 2, wherein the start and stop of water cooling are repeated intermittently at least in part of a quenching process.

6. The method for quenching a steel pipe according to claim 5, wherein the steel pipe contains 0.2 to 1.2% of C in mass %.

7. The method for quenching a steel pipe according to claim 5, wherein the steel pipe is a Cr-based stainless steel pipe containing, in mass %, 0.10 to 0.30% of C and 11 to 18% of Cr.

8. The method for quenching a steel pipe according to claim 2, wherein in order to apply water cooling onto an outer surface of the steel pipe, a first water cooling is performed in a temperature range in which the temperature of the outer surface of the steel pipe is higher than Ms point, thereafter switched to a second water cooling that is using a lesser amount of water than the first water cooling or air cooling, and the outer surface is forcedly cooled down to Ms point or lower.

9. The method for quenching a steel pipe according to claim 8, wherein the steel pipe contains 0.2 to 1.2% of C in mass %.

10. The method for quenching a steel pipe according to claim 8, wherein the steel pipe is a Cr-based stainless steel pipe containing, in mass %, 0.10 to 0.30% of C and 11 to 18% of Cr.

11. The method for quenching a steel pipe according to claim 1, wherein the start and stop of water cooling are repeated intermittently at least in part of a quenching process.

12. The method for quenching a steel pipe according to claim 11, wherein the steel pipe contains 0.2 to 1.2% of C in mass %.

13. The method for quenching a steel pipe according to claim 11, wherein the steel pipe is a Cr-based stainless steel pipe containing, in mass %, 0.10 to 0.30% of C and 11 to 18% of Cr.

14. The method for quenching a steel pipe according to claim 1, wherein in order to apply water cooling onto an outer surface of the steel pipe, a first water cooling is performed in a temperature range in which the temperature of the outer surface of the steel pipe is higher than Ms point, thereafter switched to a second water cooling that uses a lesser amount of water than the first water cooling or air cooling, and the outer surface is forcedly cooled down to Ms point or lower.

15. The method for quenching a steel pipe according to claim 14, wherein the steel pipe contains 0.2 to 1.2% of C in mass %.

16. The method for quenching a steel pipe according to claim 14, wherein the steel pipe is a Cr-based stainless steel pipe containing, in mass %, 0.10 to 0.30% of C and 11 to 18% of Cr.

17. The method for quenching a steel pipe according to claim 1, wherein the steel pipe contains 0.2 to 1.2% of C in mass %.

18. The method for quenching a steel pipe according to claim 1, wherein the steel pipe is a Cr-based stainless steel pipe containing, in mass %, 0.10 to 0.30% of C and 11 to 18% of Cr.

* * * * *